US005451079A

United States Patent [19]

Gong et al.

[11] Patent Number: 5,451,079

[45] Date of Patent: Sep. 19, 1995

[54] SELF-STANDING UNIVERSAL DIET CARD AND METHOD FOR USE OF SAME

[76] Inventors: Elaine M. Gong, 20711 E. Crest #A, Diamond Bar, Calif. 91789; Edward V. Candioty, 21613 Ladeene Ave., Torrance, Calif. 90503

[21] Appl. No.: 315,024

[22] Filed: Sep. 29, 1994

[51] Int. Cl.[6] ..... B42D 15/00

[52] U.S. Cl. ..... 283/115; 283/48.1; 283/900; 283/67

[58] Field of Search ..... 283/115, 61, 900, 48.1, 283/49, 67

[56] References Cited

U.S. PATENT DOCUMENTS

| | | | |
|---|---|---|---|
| 2,314,387 | 3/1943 | Carlsson | 283/115 X |
| 4,464,122 | 8/1984 | Fuller | 283/115 X |
| 4,650,218 | 3/1987 | Hawke | 283/115 X |
| 4,664,418 | 5/1987 | Bear | 283/115 X |
| 5,178,416 | 1/1993 | Wennik | 283/115 X |

*Primary Examiner*—Willmon Fridie
*Attorney, Agent, or Firm*—John J. Posta, Jr.

[57] ABSTRACT

A universal diet card for providing dietary information in hospitals or similar facilities and a related method for the use of the universal diet card are disclosed in which a single diet card is useable for any of a plurality of special diets and is capable of containing extensive information relative to the desired diet for an individual. The universal diet card has a plurality of colored indicia located thereon, one or more of which colored indicia may be chosen to indicate the specific type of diet(s) selected for the individual. The universal diet card has a folding score line located thereon, and it may be folded on the folding score line to form a base segment from its lower portion to support its upper portion in a standing orientation which is highly visible when placed on a meal tray or in a similar location.

20 Claims, 1 Drawing Sheet

SELF-STANDING UNIVERSAL DIET CARD AND METHOD FOR USE OF SAME

BACKGROUND OF THE INVENTION

Field of the Invention—The present invention relates generally to diet cards of the type used in hospitals or extended care facilities for providing dietary information relating to a particular individual, and more particularly to an improved diet card and related system and method of use whereby a single diet card is useable for any of a plurality of special diets and is capable of containing extensive information relative to the desired diet for an individual.

In institutions such as hospitals and extended care facilities, the use of disposables has proliferated to a remarkable extent. Everything from syringes to catheters to paper goods is designed for a single use, after which it are thrown out. This has, of course, resulted in such institutions being required to stock all such disposable items in relatively great quantities. While this has been done, it has contributed in part to a great increase in costs at such institutions which has greatly exceeded inflation.

The recent climate in health care has resulted in an ever-increasing awareness of costs, with hospitals and extended care facilities becoming more vigilant with high costs in general, and with the high cost of stocking a great number of disposable goods in particular. This has resulted in a drive toward reducing the number of disposable goods required, particularly where one such disposable item can be substituted for two or more similar items. As a result of the institutional pressure to reduce the number of different disposables stocked and used, manufacturers of goods destined for use in such institutions have also become increasingly aware of the competitive benefits of offering such multi-use disposable goods.

One small but significant disposable item commonly used in hospitals and extended care facilities is the patient diet card. Diet cards are paper cards which are typically approximately three and one-half inches by five and one-half inches in size, with a single card being used to order and deliver one or more meals for a single patient. The diet cards are typically stocked by the various facilities in seven or eight different colors, with each color indicating a different type of diet. Common examples of the different types of diets are a sodium controlled diet for individuals who are sensitive to salt, a soft/mechanical diet for individuals who can only tolerate soft foods, a diabetic diet for individuals with diabetes, a low fat/low cholesterol diet for individuals who must restrict their fat and cholesterol intake, a regular diet for individuals with no restrictions, a combination diet with two or more of the previous restrictions, and other diets such as vegetarian diets, liquid diets, and diets due to the individual's religion, etc.

In short, institutions such as hospitals and extended care facilities must stock seven or eight different diet cards in order to meet even these most common of dietary criteria in serving food to patients. It is at once apparent to those skilled in the art that the requirement of stocking seven or eight different diet cards is undesirable. Even more undesirable, however, would be carrying a generic card with the type of diet being hand-written on the diet card, since this would require even more individual attention to each card, requiring more time to be spent by one or more individuals. This, of course, would result in additional expense, which is even more of a disadvantage than stocking the seven or eight different diet cards.

Another problem with presently used diet cards is that they are intrinsically just what their name suggests—cards. As such, they are flat and incapable of standing up by themselves. If they are placed on a food tray, they do not stand out and are thus not highly visible, making it extremely difficult for the facility staff to distinguish the name and room number of the patient above the level of the tray. Thus, additional effort is required by personnel distributing the food trays to visually locate the cards, so that the correct food trays may be given to the correct patients. It is also worth noting at least in passing that the diet cards can easily be covered with articles on the food trays, presenting even more of a problem.

One potential solution to this latter problem is the use of plastic stands or base members to support the diet cards in an upright position, but this even this approach presents problems of its own. For example, it takes time and effort to insert the food cards into such stands, and the stands further represent just one additional item to be stocked by the institution. Thus, it will be appreciated that while presently available diet cards are not wholly satisfactory, they remain in wide use at this time.

It is accordingly the primary objective of the present invention that it present a single diet card and related method of use therefor which may be substituted for the seven or eight different diet cards which are presently in common use by hospitals and extended care facilities. It is a related objective that the improved single diet card and method of the present invention be a complete substitute for the seven or eight different diet cards in that the improved diet card provide thereon an easily readable indication of the particular special diet (or diets) which have been chosen for use for the intended recipient of the meal or meals to be provided together with the diet card. In addition, it is an objective of the present invention that the improved diet card and method not require substantial effort by facility personnel in order to indicate on the diet card the particular special diet (or diets) which has (have) been chosen.

In another aspect of the diet card and method of the present invention, it is an objective that the diet card be self-standing in a relatively upright position. As such, it is an objective of the present invention that the improved diet card and method do not require an additional support mechanism such as a stand or base in order for the diet card to be self-standing. It is yet another objective that the diet card of the present invention be completely flat prior to its use, both for convenient storage of unused diet cards and for ease of use by facility personnel when the diet card is to be filled out.

The diet card of the present invention must also be of construction which is relatively durable, but yet is easy to use, and in an alternate embodiment provision should be made for the diet card of the present invention to be reusable. In order to enhance the market appeal of the diet card of the present invention, it should also be relatively no more expensive than are presently known diet cards, to thereby afford it the broadest possible market. Finally, it is also an objective that all of the aforesaid advantages and objectives of the diet card and the related method of the present invention be achieved without incurring any substantial relative disadvantage.

SUMMARY OF THE INVENTION

The disadvantages and limitations of the background art discussed above are overcome by the present invention. With this invention, a universal diet card is provided which is a viable substitute for the seven or eight different diet cards commonly in use in hospitals and extended care facilities. In the preferred embodiment, this universal diet card is printed on standard card stock, in the standard index card size of three and one-half inches by five and one-half inches.

Located in a prominent position on the universal diet card of the present invention are a plurality of colored indicia, each color of which is unique and is indicative of a particular type of diet. In the preferred embodiment of the universal diet card of the present invention, the colored indicia are located along the top edge of the universal diet card. By checking one of the colored indicia, the universal diet card can become identical in content to one of the several different conventional diet cards.

One of the colored indicia may also be used on the universal diet card of the present invention to indicate a type of dietary consideration which does not fall into one of the most common dietary considerations. Next to this colored indicia, which is used to indicate "other," is a space into which may be written the type of diet desired. By checking more than one of the colored indicia if more than one of the specialized dietary considerations apply to a particular patient, the universal diet card of the present invention can become a customized diet card which is considerably more flexible that the past system using seven or eight different diet cards. Thus, the universal diet card of the present invention is a complete and highly flexible substitute for the seven or eight different diet cards previously known in the art, and possesses no disadvantages in its use.

The universal diet card of the present invention has all of the additional information common to diet cards used in the past. For example, it carries spaces for the patient name and room number, spaces for breakfast, lunch, and/or dinner menus, including beverages, and spaces for snacks such as, for example, an evening snack. If desired, it can also contain other information, such as, for example, nutritional information or patient history, etc.

In an additional aspect of the present invention, each of the universal diet cards of the present invention has located thereon a folding score line, which may be used to facilitate easily folding the universal diet card into an L-shaped configuration. In this configuration, the universal diet card of the present invention will be self-standing, with the top portion of the card thereby being supported in a highly visible position by the bottom portion of the card, which will act as a base. Since the universal diet card of the present invention has the fold line pre-scored, the folding operation is both quick and easy to do, and requires virtually no effort by facility personnel. In any event, it will at once be appreciated by those skilled in the art that the foldable universal diet card of the present invention represents a tremendous improvement over the use of a stand or base member.

In a single alternative embodiment of the present invention, the universal diet card of the present invention may be made in a plastic-coated version which may be reused. The universal diet card may easily be written on by using a wet erase marker pen, and then may be folded on the folding score line. When so written, the plastic-coated universal diet card will continue to carry its customized patient information until it is erased using a damp cloth or wet erase eraser. Such a plastic-coated universal diet card would have an extended lifetime, and would further reduce the investment in disposable paper goods required to be made by the facility.

It may therefore be seen that the present invention teaches a universal diet card and related method of use therefor which may be substituted for the seven or eight different diet cards which are presently in common use by hospitals and extended care facilities. The improved universal diet card and method of the present invention provides on the universal diet card an easily readable indication of the particular special diet (or diets) which has (have) been chosen for use for the intended recipient of the meal or meals to be provided together with the universal diet card. Significantly, the improved universal diet card and method of the present invention do not require substantial effort by facility personnel in order to indicate on the universal diet card the particular special diet (or diets) which have been chosen.

In another significant advantage of the universal diet card and method of the present invention, once folded on the folding score line, the universal diet card is self-standing in a relatively upright position where the information contained thereon is highly visible. As such, the improved universal diet card and method of the present invention do not require an additional support mechanism such as a stand or base in order for the universal diet card to be self-standing. The universal diet card of the present invention is also completely flat prior to its use, making it convenient both for the storage of as yet unused universal diet cards, and for ease of use by facility personnel when the universal diet card is to be filled out.

The universal diet card of the present invention is relatively durable, yet easy to use, and in an alternate embodiment is even reusable. The universal diet card of the present invention is relatively no more expensive than are presently known diet cards, thereby enhancing its market appeal and afford it the broadest possible market. Finally, all of the aforesaid advantages and objectives of the universal diet card and the related method of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
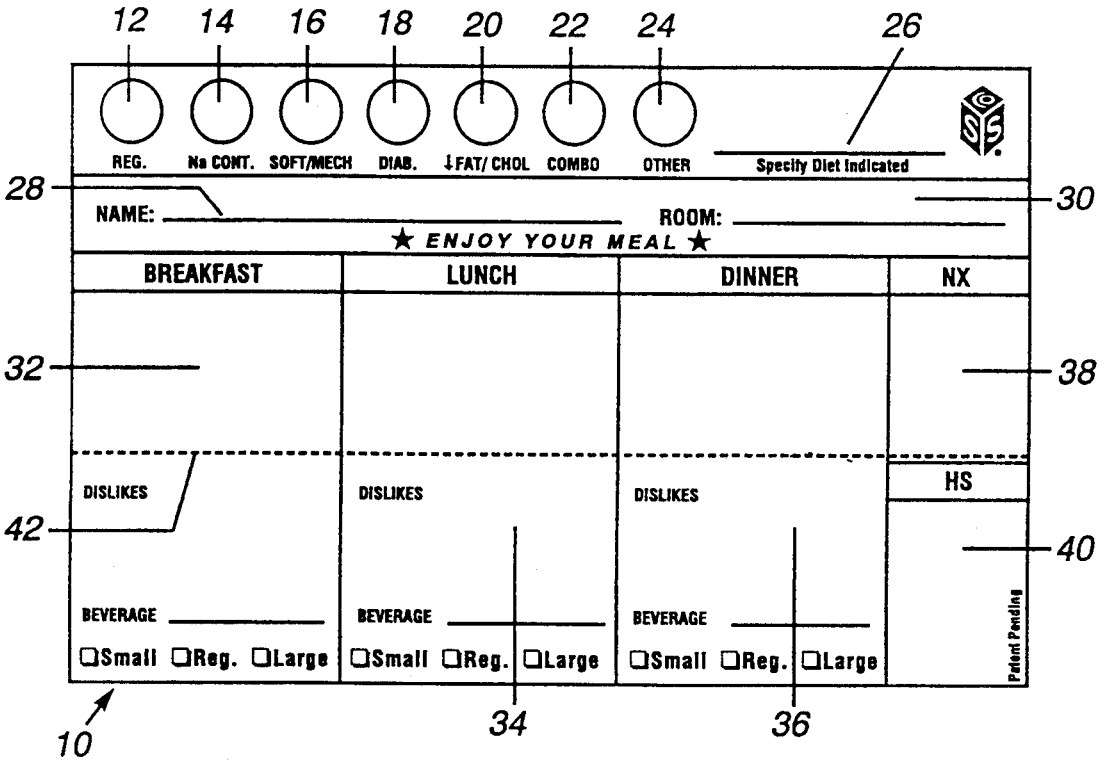
FIG. 1 is a front plan view of the preferred embodiment of the improved universal diet card of the present invention, showing a plurality of different circular labeling segments located near the top edge thereof which may be of different colors to indicate different types of diet plans, and also showing a score line along which the universal diet card may be folded over to form a base segment from the lower portion of the universal diet card as illustrated in FIG. 1.
Figure 2:
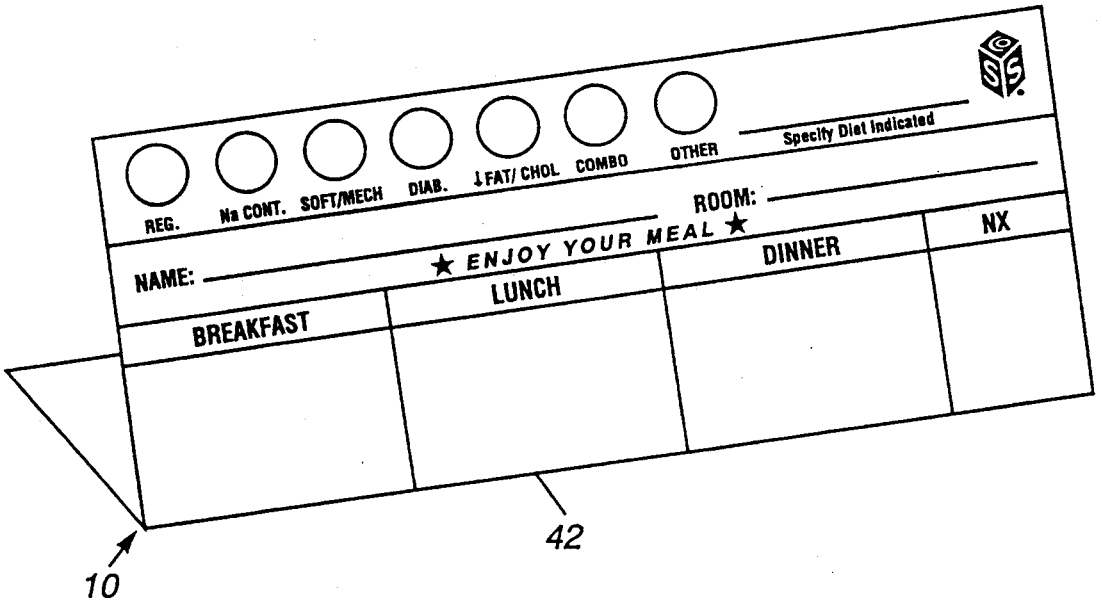
FIG. 2 is an isometric view of the universal diet card illustrated in FIG. 1 folded over upon itself to form the aforementioned base segment, which will maintain the upper portion of the universal diet card (as illustrated in FIG. 1) in an upright, slightly leaning back position substantially as illustrated in FIG. 2.

The preferred embodiment of the present invention is illustrated in its stored form in FIG. 1, and folded for use in FIG. 2. Referring first to FIG. 1, a universal diet card 10 is illustrated which, in the preferred embodiment, is made of standard card stock in the standard index card size of three and one-half inches high by five and one-half inches wide. In its stored form as illustrated in FIG. 1, the universal diet card 10 is flat, thereby making it easy to package and store and also easy to write upon.

The universal diet card 10 has a plurality of colored indicia located thereon, with each of the colored indicia for use in identifying a particular type of diet. In the preferred embodiment of the universal diet card 10 of the present invention illustrated in FIG. 1, these colored indicia are located along the top edge of the universal diet card, beginning at the left side of the universal diet card 10 and extending toward the right side of the universal diet card 10. It will be understood that although neither colored drawings nor color-indicating hatching are used in the colored indicia illustrated in FIG. 1, the colored indicia appear as colored circles on the universal diet card 10.

In the preferred embodiment, the left-most of the colored indicia is a green circle 12, below which appears the abbreviation "REG," which stands for regular diet. To the immediate right of the green circle 12 appears a gray circle 14, below which appears the abbreviation "Na CONT," which stands for sodium controlled diet. To the immediate right of the gray circle 14 is a red circle 16, below which appears the abbreviation "SOFT/MECH," which stands for soft/mechanical diet.

To the immediate right of the red circle 16 is a yellow circle 18, below which appears the abbreviation "DIAB.," which stands for diabetic diet. To the immediate right of the yellow circle 18 is a orange circle 20, below which appears the abbreviation "↓FAT/-CHOL," which stands for low fat/low cholesterol diet. To the immediate right of the orange circle 20 is a blue circle 22, below which appears the abbreviation "COMBO," which stands for combination diet.

Finally, to the immediate right of the blue circle 22 is a white circle 24, below which appears the abbreviation "OTHER," which stands for a type of diet other than those specifically indicated on the universal diet card 10. To the right of the white circle 24 is an area indicated generally by the reference numeral 26 above a line, below which line the text "Specify Diet Indicated" appears. In this area 26, the specific type of diet not specifically listed on the universal diet card 10 (and indicated by the white circle 24 being selected) may be written in. Examples of diets not specifically indicated by one of the other colored indicia on the universal diet card 10 which could be written into the area 26 include a vegetarian diet, a kosher diet, and a liquid diet.

Located below the colored indicia is an area indicated generally by the reference numeral 28 above a line, to the left of which line the text "NAME" appears. In this area 28, the name of the patient for whom the universal diet card 10 is being prepared may be written. To the right of the area 28 is an area indicated generally by the reference numeral the area 30 above a line, to the left of which line the text "ROOM" appears. In this area 30, the room number of the patient for whom the universal diet card 10 is being prepared may be written.

Below the areas 28 and 30, the universal diet card 10 is divided into three wider columns beginning at the left edge of the universal diet card 10 and a fourth narrower column to the right of the three wider columns and extending to the right edge of the universal diet card 10. The left-most of the wider columns is indicated generally by the reference numeral 32, the middle one of the wider columns is indicated generally by the reference numeral 34, and the right-most of the wider columns is indicated generally by the reference numeral 36. The upper half of the narrower column is indicated generally by the reference numeral 38, and the lower half of the narrower column is indicated generally by the reference numeral 40.

Located at the top of the left-most of the wider columns 32 is the word "BREAKFAST." Located at the top of the middle one of the wider columns 34 is the word "LUNCH." Located at the top of the right-most of the wider columns 36 is the word "DINNER." Thus, the three wider columns 32, 34, and 36 respectively contain space into which the details of breakfast, lunch, and/or dinner menus can be written on the universal diet card 10.

With the exception of the name of the meal at the top, the three wider columns 32, 34, and 36 are otherwise identical in their content. At the bottom of each of the three wider columns 32, 34, 36 are three boxes labeled "Small," "Medium," and "Large," which are used to select the size of the meal. Located immediately above these three boxes is an area into which the name of the desired beverage to accompany the particular mean may be written. Located just above the beverage area is an area into which the patient's likes or preferences (or, alternately, the patient's dislikes) may be written.

Referring next to the upper half of the narrower column 38, at the top the abbreviation "NX" is written. Information relating to nutritional information or patient history may be written in the upper half of the narrower column 38. The abbreviation "HS" is written at the top of the lower half of the narrower column 40, and information relating to an evening snack may be written in the lower half of the narrower column 40.

It will of course be appreciated by those skilled in the art that the exact configuration and content of information which may be entered on the universal diet card 10 may be varied considerably without departing from the spirit of the present invention. The essential element are the colored indicia located on the universal diet card 10, although the exact configuration, location, and number of even the colored indicia may be varied in a virtually infinite number of obvious variations which may be made to the present invention.

The second essential element of the universal diet card 10 of the present invention is a folding score line 42, which extends across the entire width of the universal diet card 10 and is illustrated in FIG. 1 by a dotted line. The folding score line 42 may be stamped onto the universal diet card 10, and in the preferred embodiment is not perforated therethrough (although such perforation may be used in an alternate embodiment) but rather stamped or cut into the surface of the universal diet card 10. The folding score line 42 is located slightly nearer the bottom of the universal diet card 10 than it is near the top of the universal diet card 10.

The universal diet card 10 may be filled in as desired, and then folded on the folding score line 42 as is illustrated in FIG. 2. In cross-section, the folded universal diet card 10 will be generally L-shaped (when viewed edge-on from the side shown at the right in FIG. 2). Thus, the lower portion of the universal diet card 10 (as illustrated in FIG. 1) will function as a base to support the upper portion of the universal diet card 10 (as illustrated in FIG. 1) in a standing position, which standing position is illustrated in FIG. 2.

In the preferred embodiment discussed above, the universal diet card 10 is made of standard card stock, and is designed to be used once (or for one day's meals) and then thrown out. In an alternative embodiment, the universal diet card 10 may instead be made in a 20 mil plastic-coated version, which will appear exactly as shown in FIGS. 1 and 2. The plastic-coated version of the universal diet card 10 is scored in the same manner with the folding score line 42, and is folded in the same way.

The only difference in use of the plastic-coated universal diet card 10 is that it is written upon using a wet erase marker pen prior to folding it. The information thereby written on the plastic-coated universal diet card 10 may be removed by using a damp cloth or wet erase eraser to wipe the universal diet card 10 clean. Thus, the plastic-coated universal diet card 10 may be reused a number of times rather than being disposed of after a single use.

In an additional enhancement, the universal diet cards 10 may be supplied in a box (not shown) which may act as a handy file system to hold and store the universal diet cards 10. If the universal diet card 10 are plastic-coated, they may also include a set of divider cards (not shown) and a wet market pen (not shown) to make using the universal diet cards 10 even easier and more efficient.

It may therefore be appreciated from the above detailed description of the preferred embodiment of the present invention that it teaches a universal diet card and related method of use therefor which may be substituted for the seven or eight different diet cards which are presently in common use by hospitals and extended care facilities. The improved universal diet card and method of the present invention provides on the universal diet card an easily readable indication of the particular special diet (or diets) which has (have) been chosen for use for the intended recipient of the meal or meals to be provided together with the universal diet card. Significantly, the improved universal diet card and method of the present invention do not require substantial effort by facility personnel in order to indicate on the universal diet card the particular special diet (or diets) which have been chosen.

In another significant advantage of the universal diet card and method of the present invention, once folded on the folding score line, the universal diet card is self-standing in a relatively upright position where the information contained thereon is highly visible. As such, the improved universal diet card and method of the present invention do not require an additional support mechanism such as a stand or base in order for the universal diet card to be self-standing. The universal diet card of the present invention is also completely flat prior to its use, making it convenient both for the storage of as yet unused universal diet cards, and for ease of use by facility personnel when the universal diet card is to be filled out.

The universal diet card of the present invention is relatively durable, yet easy to use, and in an alternate embodiment is even reusable. The universal diet card of the present invention is relatively no more expensive than are presently known diet cards, thereby enhancing its market appeal and afford it the broadest possible market. Finally, all of the aforesaid advantages and objectives of the universal diet card and the related method of the present invention are achieved without incurring any substantial relative disadvantage.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A universal diet card for allowing dietary information to be inscribed thereon for a particular individual, said universal diet card comprising:

a thin, flat card having a front side and a back side, said front side of said card having a top edge, a bottom edge, a right side edge, and a left side edge;

a plurality of colored indicia located in a spaced-apart array in a prominent position on said front side of said card, each of said colored indicia being of a different color and representing a particular type of diet regime;

an area located on said front side of said card where the name of an individual may be inscribed;

an area located on said front side of said card where additional information relating to the dietary regime prescribed for the individual may be inscribed; and a folding score line extending across the entire width of said card between said right side edge of said card and said left side edge of said card, said folding score line being located intermediate said top edge of said card and said bottom edge of said card, said card being divided by said folding score line into a first segment located intermediate said folding score line and said top edge of said card and a second segment located intermediate said folding score line and said bottom edge of said card, said card being foldable along said folding score line in a manner whereby said second portion of said card will constitute a base which when placed on a horizontal surface will support said first segment of said card in a relatively upright position.

2. A universal diet card as defined in claim 1, wherein said card is made of paper card stock.

3. A universal diet card as defined in claim 1, wherein said card is approximately three and one-half inches in height from said top edge of said card to said bottom edge of said card, and approximately five and one-half inches in width between said right side edge of said card and said left side edge of said card.

4. A universal diet card as defined in claim 1, wherein said card is made of plastic-coated paper material, whereby information may be inscribed on said card with a wet erase marker pen or the like, and whereby the information so inscribed on said card may be erased from said card by wiping said card with a damp cloth or a wet erase eraser and said card may be reused.

5. A universal diet card as defined in claim 1, wherein said colored indicia each comprise:

a discrete colored area located on said front side of said card, wherein said colored indicia are each adapted and configured to be inscribed upon in order to select the particular type of diet regime associated with said inscribed upon colored indicia.

6. A universal diet card as defined in claim 5, wherein said colored indicia each comprise a circular segment of a different color.

7. A universal diet card as defined in claim 5, wherein said colored indicia are each located adjacent said top edge of said card in a row.

8. A universal diet card as defined in claim 1, additionally comprising:

an area located on said front side of said card adjacent one of said colored indicia where information describing a diet regime not represented by any of the other colored indicia may be inscribed.

9. A universal diet card as defined in claim 1, wherein said colored indicia represent at least four of the dietary regimes from the group consisting of a regular diet, a sodium controlled diet, a soft/mechanical diet, a diabetic diet, a low fat/low cholesterol diet, a combination diet, a vegetarian diet, a kosher diet, a liquid diet, and a type of diet not pre-specified on said card.

10. A universal diet card as defined in claim 1, additionally comprising:

written abbreviations located on said front side of said card adjacent each of said colored indicia, each of said written abbreviations being associated with the one of said colored indicia it is adjacent to, each of said written abbreviations being an abbreviation representing the particular type of diet regime associated with the one of said colored indicia located adjacent the particular written abbreviation.

11. A universal diet card as defined in claim 1, wherein said folding score line comprises:

a line stamped or cut into the surface of said card, said card thereby naturally tending to bend along said folding score line when said card is bent.

12. A universal diet card as defined in claim 1, wherein said folding score line comprises:

a perforated line extending across the surface of said card, said card thereby naturally tending to bend along said folding score line when said card is bent.

13. A universal diet card as defined in claim 1, wherein said folding score line is located nearer said bottom edge of said card than it is near said top edge of said card.

14. A universal diet card as defined in claim 1, additionally comprising:

an area located on said front side of said card where the room number or location of the individual may be inscribed.

15. A universal diet card as defined in claim 1, additionally comprising:

an area located on said front side of said card where menus for breakfast, lunch, and/or dinner for the individual may be inscribed.

16. A universal diet card as defined in claim 1, additionally comprising:

an area located on said front side of said card where the portion sizes for the individual may be inscribed.

17. A universal diet card as defined in claim 1, additionally comprising:

an area located on said front side of said card where food likes and/or dislikes of the individual may be inscribed.

18. A universal diet card for allowing dietary information to be inscribed thereon for a particular individual, said universal diet card comprising:

a thin, flat card having a front side and a back side, said front side of said card having a top edge, a bottom edge, a right side edge, and a left side edge;

a plurality of colored indicia located in a spaced-apart row adjacent said top edge of said front side of said card, each of said colored indicia being of a different color and representing a particular type of diet regime; and a folding score line stamped, cut, or perforated into the surface of said card and extending across the entire width of said card between said right side edge of said card and said left side edge of said card, said folding score line being located intermediate said top edge of said card and said bottom edge of said card and nearer said bottom edge of said card than it is near said top edge of said card, said card being divided by said folding score line into a first segment located intermediate said folding score line and said top edge of said card and a second segment located intermediate said folding score line and said bottom edge of said card, said card being foldable along said folding score line in a manner whereby said second portion of said card will constitute a base which when placed on a horizontal surface will support said first segment of said card in a relatively upright position.

19. A universal diet card for allowing dietary information to be inscribed thereon for a particular individual, said universal diet card comprising:

a thin, flat card having a front side and a back side, said front side of said card having a top edge, a bottom edge, a right side edge, and a left side edge;

a plurality of colored indicia located in a spaced-apart array in a prominent position on said front side of said card, each of said colored indicia being of a different color and representing a particular type of diet regime; and a folding score line extending across the entire width of said card between said right side edge of said card and said left side edge of said card, said folding score line being located intermediate said top edge of said card and said bottom edge of said card, said card being divided by said folding score line into a first segment located intermediate said folding score line and said top edge of said card and a second segment located intermediate said folding score line and said bottom edge of said card.

20. A method for allowing dietary information for a particular individual to be inscribed on a universal diet card, said method comprising:

selecting at least one of a plurality of colored indicia located in a spaced-apart array in a prominent position on a front side of a thin, flat card, said card having a front side and a back side, said front side of said card having a top edge, a bottom edge, a right side edge, and a left side edge, each of said colored indicia being of a different color and representing a particular type of diet regime;

inscribing the name of an individual on an area located on said front side of said card;

inscribing additional information relating to the dietary regime prescribed for the individual on an area located on said front side of said card; and folding said card along a folding score line extending across the entire width of said card between said right side edge of said card and said left side edge of said card, said folding score line being located intermediate said top edge of said card and said bottom edge of said card, said card being divided by said folding score line into a first segment located intermediate said folding score line and said top edge of said card and a second segment located intermediate said folding score line and said bottom edge of said card, said card being foldable along said folding score line in a manner whereby said second portion of said card will constitute a base which when placed on a horizontal surface will support said first segment of said card in a relatively upright position.

* * * * *